US011959263B2

(12) United States Patent
Stefini et al.

(10) Patent No.: US 11,959,263 B2
(45) Date of Patent: Apr. 16, 2024

(54) DRAIN FOR SANITARY FIXTURES

(71) Applicant: RAVANI S.r.l., Lumezzane (IT)

(72) Inventors: Federico Stefini, Lumezzane (IT); Marco Dalmazio Ravani, Lumezzane (IT)

(73) Assignee: RAVANI S.r.l., Lumezzane (IT)

( * ) Notice: Subject to any disclaimer, the term of this patent is extended or adjusted under 35 U.S.C. 154(b) by 187 days.

(21) Appl. No.: 17/311,946

(22) PCT Filed: Nov. 11, 2019

(86) PCT No.: PCT/IB2019/059663
§ 371 (c)(1),
(2) Date: Jun. 8, 2021

(87) PCT Pub. No.: WO2020/128669
PCT Pub. Date: Jun. 25, 2020

(65) Prior Publication Data

US 2022/0064922 A1 Mar. 3, 2022

(30) Foreign Application Priority Data

Dec. 20, 2018 (IT) ..... 102018000020326

(51) Int. Cl.
*E03C 1/232* (2006.01)
*E03C 1/23* (2006.01)

(52) U.S. Cl.
CPC ..... *E03C 1/232* (2013.01); *E03C 1/2306* (2013.01); *E03C 2001/2311* (2013.01); *E03C 2001/2317* (2013.01)

(58) Field of Classification Search
CPC ..... E03C 1/232; E03C 1/2306; E03C 2001/2311; E03C 2001/2317
(Continued)

(56) References Cited

U.S. PATENT DOCUMENTS 5,208,921 A * 5/1993 Nicoll ..... E03C 1/23 4/689
9,151,027 B2 * 10/2015 Lucas ..... E03C 1/2306
2018/0127961 A1 5/2018 Homami et al.

FOREIGN PATENT DOCUMENTS

DE 2825978 A1 2/1980
DE 2950611 A1 6/1981
(Continued)

*Primary Examiner* — Tuan N Nguyen
(74) *Attorney, Agent, or Firm* — Conley Rose, P.C.; Ryan D. Jenlink

(57) ABSTRACT

A drain for sanitary fixtures such as sinks, tubs or the like is described. The drain is provided with an automatic overflow mechanism, of the magnetic type, configured to be automatically activated when the water level in the sanitary fixture reaches the maximum level allowed. The overflow mechanism comprises a first magnetic element arranged on a stem of the plug, and a second magnetic element integral with the head of the plug and in-between the base and the first magnetic element. In the raised position of the plug, corresponding to the raised position of the head, the first magnetic element and the second magnetic element are magnetically coupled. When a threshold value of the water pressure acting on the head is exceeded, the first magnetic element and the second magnetic element are automatically uncoupled, causing the descent of the head towards the lowered position, corresponding to the opening of the mouth of the sanitary fixture initially closed by the plug.
The drain preferably further comprises a manual lifting mechanism to lift the plug, configured to bring back the plug to the raised closed position following activation. Preferably, also the lifting mechanism is magnetic.

20 Claims, 2 Drawing Sheets

(58) Field of Classification Search
USPC ..... 4/679, 680, 684, 688, 689, 287, 295
See application file for complete search history.

(56) References Cited

FOREIGN PATENT DOCUMENTS

| | | | | |
|---|---|---|---|---|
| EP | 2281955 | A1 | | 9/2011 |
| WO | WO-9116847 | A1 | * | 11/1991 |
| WO | 02/18718 | A1 | | 3/2002 |
| WO | 2016006989 | A1 | | 1/2016 |

* cited by examiner

DRAIN FOR SANITARY FIXTURES

FIELD OF THE INVENTION

The present invention concerns a drain for sanitary fixtures, such as sinks, washbasins and the like, provided with an overflow mechanism.

STATE OF THE ART

In the industry of sanitary fixtures, it is known to make sinks, washbasins and tubs which, for aesthetic reasons, are devoid of the overflow hole, i.e. are not provided with the hole for draining excess water, a hole which, in most sanitary fixtures, is obtained in the side wall to prevent the level of water contained in the sanitary fixture from exceeding a maximum value and overflowing outside.

EP-A-2281955, in the name of the Applicant, describes a drain comprising a cylindrical body having a bottom grid at the base and, at its top, an annular rosette delimiting the mouth for the passage of water through the drain body. A plug is housed in the drain body and is axially movable between a lowered position, wherein the head of the plug is under the rosette and does not intercept the opening of the mouth, thus allowing the passage of water, and a raised position, wherein the head of the plug intercepts the rosette and prevents the passage of water through the mouth. For this reason, the head of the plug is provided with an O-ring gasket adapted to cooperate with the inner edge of the annular rosette, so that to seal the mouth when the head of the plug is at the level of the rosette.

The plug leans on the bottom grid of the drain body by means of a helical spring which is calibrated so that to yield at the exceeding of a predefined pressure value: when the water volume contained in the sanitary fixture reaches and exceeds a maximum value, at the maximum tolerable level of water, the pressure acting on the plug exceeds the predefined value and overcomes the resistance provided by the helical spring, which yields, thus causing the lowering of the plug and, thus, the draining of the water through the drain. When the pressure exerted by the water decreases beyond the predefined value, because the water level has lowered, the helical spring automatically brings back the plug to the closed position, and this because the water pressure is no longer able to counter the thrust exerted by the helical spring.

Thus, the drain integrates an overflow mechanism; the drain automatically opens to drain excess water and to prevent it from overflowing, and automatically closes when the water level reaches a value below the predefined limit. In other words, the overflow mechanism is automatic.

EP-A-2281955 also describes a solution wherein the overflow mechanism is magnetic. More in detail, a first magnetic element is combined with one between plug and drain body, and a second magnetic or ferromagnetic element is combined with the other between drain and plug; the magnetic elements are adapted to cooperate to allow/prevent the lowering of the plug. The operation is equivalent to the one described previously: at the exceeding of a predefined pressure value, the magnetic elements separate from one another and the plug lowers to drain the water. In this embodiment, the raising of the overflow mechanism, i.e. the magnetic coupling of the magnetic elements following the reciprocal separation due to the hydrostatic pressure, is automatic. In fact, the drain further comprises an elastic element arranged between the plug and the bottom grid, which compresses when the magnetic elements separate from one another, and which extends when the water level drops under the predefined level, thus bring back the magnetic elements to reciprocal coupling. In practice, when the water pressure acting on the plug decreases below the threshold value, the elastic element automatically extends, thus bringing back the magnets to the coupled position and the plug to the closed position.

US 2018/127961 describes a drain provided with an overflow mechanism of the magnetic type, comprising a spring and two magnets. The two magnets are fastened, respectively, at the lower portion and at the upper portion of the plug. In practice, the two magnets attract one another and cooperate with the spring to ensure the complete raising of the plug to the closed position, after the excess water was drained, and to keep the plug in such position, thus avoiding leaks. This document generically also describes the possibility to insert, in the same drain, a lifting mechanism to lift the plug, for example of the click-clack type. US 2018/127961 does not however go into detail on how the two mechanisms can be integrated, i.e. how they must cooperate or, in other words, how the raising of the overflow mechanism can be or must be subordinated to the activation of the lifting mechanism.

Other drains according to the known art are described in AU 64831262, WO 97/00917, WO 91/16847, WO 02/18718, DE 2825978, DE2950611 and WO 2016/006989.

Drains not provided with the overflow mechanism, wherein the plug is only movable between two extreme positions completely closed and opened, and the displacement is imparted manually by the user, are also known: for this purpose, the drain integrates a trip mechanism commonly defined "click-clack," which operates similarly to the actuator usually used in ballpoint pens to drive the extraction of the tip from the body of the pen, by pressing a button with the thumb, always in the same direction. In the case of drains, the user must act directly on the plug, with a finger, to impart an axial thrust on the plug, always downwards, so that to trigger the click-clack mechanism and cause the switching of the plug alternatively from the closed position to the open one, and vice-versa. An example is described in EP-A-1338707.

The applicant found the following issues in the use of known drains.

First of all, the click-clack mechanisms used in known drains have a complex structure, with numerous components that are difficult to mold and assemble; the assembly is done by hand, and this has negative impact on the final cost of the drain.

A further inconvenient consists in the fact that it is not easy to integrate a traditional click-clack mechanism and an overflow mechanism in the same drain, because there is a necessity to use elastic elements or magnets that maintain the stiffness constant and magnetic attraction/repulsion characteristics overtime, and also a necessity for the supply of the elastic and magnetic elements to be of quality at the production level, as it would otherwise be particularly difficult to achieve the proper calibration of the two mechanisms (click-clack and overflow).

Moreover, the click-clack mechanisms are sometimes not performing, because they can get stuck or because they have a non-sliding behavior.

It is incautious to use drains not provided with the overflow mechanism in sanitary fixtures not provided with the overflow hole, due to the risk that water can overflow. Thus, it is desirable to have drains provided with such mechanism, which automatically brings back the plug to the closed position; however, the drains of this type force the user to immerse the hand in water to bring the plug to the position of complete opening, and this circumstance can be unpleasant if the water is very hot. For example, if the drain with the automatic overflow mechanism is used in a sink filled with water at 80° C., the user can only drain the water by immersing the hand, clearly by protecting it with a glove, and by manually opening the drain by applying a downwards thrust on the plug. Similarly, if the sink is full of dirty water, the user does not want to dirty the hands, i.e. wants the dirty water to drain without immersing the hand to actuate the drain.

The same inconvenient just described also arises when using drains only provided with the click-clack mechanism and not provided with the overflow mechanism: the user must push the plug manually to bring it to the open position so that the water is drained and must thus immerse the hand in water to reach the drain.

A drawback of traditional overflow mechanisms is constituted by the fact that the springs used to automatically bring back the plug to the raised position, thus closing the mouth, may not provide constant performances over time, for example if the spring suffered fatigue at the increasing number of activations.

A further drawback is constituted by the fact that traditional overflow mechanisms provide for the automatic raising of the plug, whereas for some uses, such as in sinks, it is preferable that the overflow mechanism allows to fully empty the sanitary fixture.

SUMMARY OF THE INVENTION

Object of the present invention is thus to provide a drain for sanitary fixtures that overcomes the limits and drawbacks of the known solutions, thus being relatively simple to make with an overflow mechanism other than the traditional spring mechanisms and that can effectively and easily be integrated with a lifting mechanism.

A further object of the present invention is to provide a drain for sanitary fixtures with a simple to make overflow mechanism that allows to fully empty the sanitary fixture.

The present invention thus concerns the drain according to claim 1.

In particular, the drain comprises a body that can be fastened to a sanitary fixture, for example a sink, and provided with a base and a top. The base comprises an opening for draining the water and the top delimits the mouth for the inflow of the water into the body of the drain; when the drain is open, the water enters through the mouth, passes through the body of the drain and flows through the opening in the base, towards a siphon or a drain pipe connected to the drain.

A plug is housed in the body of the drain and movable with respect to it between a lowered position, at which the plug does not intercept the mouth, thus allowing the passage of water, and a raised position, at which the plug closes the mouth and prevents the passage of water.

The drain further comprises an overflow mechanism combined with the plug and configured to allow the plug to automatically lower, thus opening the mouth, when a threshold value of the water pressure exerted on the plug itself is exceeded.

The overflow mechanism is magnetic and comprises a first elastic element. The fact that the overflow mechanism is magnetic allows to make the mechanism with a relatively simple, compact, easy to assemble and to calibrate structure that can easily be integrated with a lifting mechanism to lift the plug. The magnetic elements can be of small sizes, so that to be able to easily be inserted in the drain, and provide constant performances over time, also following numerous activations, unlike the traditional springs.

Advantageously, the reloading of the overflow mechanism is subordinated to the compression of the first elastic element exerted by a user.

In practice, the reloading of the overflow mechanism, i.e. the return of the so overflow mechanism to the initial configuration, which allows the plug to automatically lower when the water level exceeds the predefined level, is not automatic but is only achieved if a user exerts a force on the plug, preferably downwards, so that to compress the first elastic element.

For the purposes of the present invention, automatic raising of the plug means the closing movement of the plug, following the activation of the overflow mechanism, automatically caused by a first elastic element, i.e. without the need for a user to exert any force thereon, and controlled raising, or reloading, means the raising movement of the plug, following the activation of the overflow mechanism, operated by the user and subordinated to the compression of the first elastic element just by the user.

In substance, as will become clearer below, unlike the traditional solutions provided with an automatic raising, the magnetic overflow mechanism described herein allows to fully empty the sanitary fixture, i.e. it is made so that to achieve the controlled, and non-automatic, raising of the plug, i.e. so that the reloading of the overflow mechanism and the raising of the plug are not automatic, but subordinated to the compression of the first elastic element.

Preferably, the plug comprises a stem extending along a longitudinal axis between a lower portion and an upper portion. The plug further comprises a head cooperating with the inner edge of the mouth for sealing the mouth itself and for preventing the passage of water. The head of the plug is coaxially fitted on the upper portion of the stem and is slidable relative thereto between a raised position and a lowered position (with respect to the upper portion of the stem). In this paragraph, the raised and lowered positions refer to the head of the plug and not to the plug as a whole: in fact, as will be explained in detail, the overflow mechanism provides for the lowering of the head of the plug only, for a length sufficient to open the mouth.

The overflow mechanism according to the preferred embodiment of the present invention comprises a first magnetic element arranged on the upper portion of the stem of the plug, and a second magnetic element integral with the head and in-between the base and the first magnetic element. In the raised position of the plug, corresponding to the raised position of its head, the first magnetic element and the second magnetic element are magnetically coupled, i.e. close to one another by means of the reciprocal attraction, and, when a threshold value of the water pressure acting on the head of the plug is exceeded, the first magnetic element and the second magnetic element are automatically uncoupled, causing the descent of the head of the plug towards the lowered position, corresponding to the opening of the mouth.

In practice, the overflow mechanism operates depending on the calibration of the respective magnetic elements: the force of attraction must be lower than the thrust exerted by the water on the head of the plug when the water reaches the maximum level allowed in the sanitary fixture. During the assembling step, the manufacturer provides to mount the magnetic elements with the proper calibration.

Preferably, the head comprises a bushing slidingly fitted on the stem and an upper portion, which carries out the closing of the mouth in the raised position, fitted on the bushing with a telescopic coupling. The bushing and the upper portion of the plug are movable along the longitudinal axis in two modes:

integrally between the raised position and the lowered position of the head of the plug, and separately: the bushing returns inside the upper portion of the head, thus allowing the further lowering of the upper portion in the body of the drain, when the bushing reaches a descent stop, corresponding to the overflow mechanism being active and the mouth being open.

Preferably, the housing acts as a descent stop for the bushing which, in its movement towards the base of the body of the drain, abuts against the upper surface of the housing at a certain point.

Preferably, the second magnetic element is arranged aboard the bushing, for example being glued thereon.

Preferably, the first elastic element can be compressed for bringing the first magnetic element and the second magnetic element back to magnetic coupling following the activation of the overflow mechanism. In other words, when the overflow mechanism is automatically activated when the maximum level of water in the sanitary fixture is reached, the first and the second magnetic elements separate and the plug lowers to open the mouth and drain the water completely. In order to bring back the plug in the closing position, it is necessary to reload the overflow mechanism, and this is done manually by pushing the plug downwards, thus compressing the first elastic element and magnetically coupling the first and the second magnetic elements.

The raising of the plug with the overflow mechanism reloaded is carried out by a lifting mechanism, as will be described below.

In fact, the drain preferably further comprises a lifting mechanism to lift the plug, intended to bring back the plug in the raised position, in response to a stress imparted by the user.

The lifting mechanism can be mechanical, depending on the use of springs, or magnetic.

The preferred lifting mechanism of the magnetic type, for which the Applicant reserves the right to deposit a divisional patent application, will now be described: in fact, the lifting mechanism that will now be described is usable in a drain independently of the other characteristics described above, for example independently of the overflow mechanism.

Preferably, the overflow mechanism is independent of the lifting mechanism in opening the mouth when the threshold value of the water pressure acting on the plug itself is exceeded. In other words, the overflow mechanism can intervene by opening the plug to drain excess water, independently of the operation of the lifting mechanism.

Preferably, the closing of the mouth by the overflow mechanism, after the latter having been activated to drain excess water, is subordinated to the activation of the lifting mechanism by the user. In other words, after the overflow mechanism has been activated, the reloading is driven by the user by means of the lifting mechanism; in practice, the two mechanisms are independent of one another, except in the step of raising the plug, during which the lifting mechanism brings back the plug to the closed position, in response to a force exerted by the user on the plug.

In practice, the controlled raising of the plug is subordinated both to the compression of the first elastic element of the overflow mechanism and to the activation of the lifting mechanism determined by the compression of the second elastic element, described below.

Preferably, the overflow mechanism and the lifting mechanism are housed in the drain at different heights along the axis of the drain.

Preferably, the lifting mechanism comprises a second elastic element deformable during the descent of the plug, for example a spring that can be loaded by compression.

More in detail, the plug comprises a third magnetic element and the lifting mechanism comprises a fourth magnetic element; the third magnetic element is interposed between the base of the body of the drain and the fourth magnetic element. The second elastic element exerts a thrust on the plug towards the relative raised position and, in the raised position of the plug, the third magnetic element and the fourth magnetic element are magnetically coupled, i.e. they attract one another.

Many advantages are offered by the solution just described.

First of all, the magnetic lifting mechanism is simpler to make with respect to a traditional click-clack mechanism, in the sense that it can be made with a lower number of pieces, having a simple structure, and that it is easier to assemble.

Moreover, the magnetic coupling between the third magnetic element and the fourth magnetic element ensures to achieve the complete raising of the plug, also when the second elastic element pushing the plug upwards loses effectiveness over time.

A further advantage is given by the fact that the magnetic lifting so mechanism can easily be integrated with an overflow mechanism, much more so than it would be—all conditions alike—with respect to a click-clack mechanism. By equipping the drain with an overflow mechanism, whose operation can depend on the use of elastic or magnetic elements, as described above, it is possible to simply achieve the optimal calibration of the two mechanisms: in particular, the magnetic elements of the lifting mechanism can easily be calibrated to remain magnetically coupled and not to separate when the overflow mechanism is automatically activated when the threshold value of the water level in the sanitary fixture is reached.

The solution suggested is particularly appropriate for use in sinks, wherein very hot water is often used and immersing the hands may not be possible without gloves, and wherein dirty water or water mixed with aggressive detergents is used.

Preferably, the fourth magnetic element is stationary with respect to the body, for example it is arranged on a support or housing at a distance from the base of the body of the drain corresponding to the maximum travel of the plug.

Preferably, the drain comprises a housing extending from the base towards the inside of the body. A first hole is obtained at the end of the housing opposite the base, and the lower portion of the plug, identifiable in the stem that will be described below, is slidingly inserted in the first hole. The third magnetic element is arranged in the lower portion of the plug and integrally moves with it inside the housing, between a lowered position and a raised position. The fourth magnetic element is positioned at the first hole, integral with the housing, and therefore with the body. This configuration allows to have the third magnetic element movable with the lower part of the plug between the base of the body of the drain and the second elastic element positioned at the end of the housing opposite the base; the displacement allowed is equivalent to the travel of the plug.

Preferably, the second elastic element is positioned in the housing, functionally interposed between the base and the lower portion of the plug. For example, the second elastic element is a helical spring that operates by compression:

when the plug is lowered by the user, who exerts a thrust from the top towards the bottom, the spring is compressed and when the user releases the plug, the spring pushes the plug upwards, i.e. towards the raised position. In this circumstance, the third magnetic element and the fourth magnetic element cooperate, by attracting one another, to ensure the proper positioning of the plug in the raised position and thus the effective closing of the mouth. In other words, the magnetic coupling between the third magnetic element and the fourth magnetic element occurs at the stop of the lower portion of the plug, the lower portion being completely extracted from the housing.

In the preferred embodiment, the plug comprises a stem extending along the longitudinal axis and that is slidingly inserted in the first hole present in the housing of the second elastic element. The third magnetic element is arranged in the lower portion of the stem and moves with it inside the housing between a lowered position and a raised position. As disclosed above, the fourth magnetic element is positioned at the first hole, integral with the housing, and therefore with the body of the drain.

Preferably, the fourth magnetic element is toroidal and surrounds the lower portion of the plug, for example extending around the first hole of the housing in which the lower portion of the plug (the stem) is slidingly inserted.

The magnetic coupling between the third magnetic element and the fourth magnetic element is reversible, i.e. the third magnetic element can be manually separated and moved away from the fourth magnetic element, by exerting a downwards thrust on the plug, i.e. a thrust towards the base of the drain.

The switching of the plug from the lowered position to the raised position occurs in response to the initial compression of the first elastic element and the second elastic element, exerted by the user, and to their following extension.

The magnetic elements are calibrated so that the force necessary for separating the first magnetic element from the second magnetic element is lower than the force necessary for separating the third magnetic element from the fourth magnetic element. This characteristic allows to achieve the automatic activation of the overflow mechanism before the water pressure becomes sufficient to overcome the upwards thrust exerted on the plug by the lifting mechanism.

In particular, the force necessary for separating the first magnetic element from the second magnetic element is exerted by the water being at the maximum level allowed in the sanitary fixture, and the force necessary for separating the third magnetic element from the fourth magnetic element is exerted manually by the user by pushing the plug towards the base of the body of the drain.

The operation of the drain is simple: when the water level in the sanitary fixture reaches the maximum allowed, the overflow mechanism is automatically activated, and the plug lowers in the body of the drain, thus opening the mouth. The plug does not close the mouth again until all the water contained in the sanitary fixture has been drained, but remains in a lowered position. At this point, the user can intervene when desired by further pushing the plug downwards, i.e. towards the base of the drain so that to reload the overflow mechanism and, by releasing the plug, to allow the lifting mechanism to bring it back to the raised position, thus closing the mouth, the user otherwise leaves the drain with the plug lowered for the normal operation of the sanitary fixture with running water.

BRIEF LIST OF THE FIGURES

Further characteristics and advantages of the invention will be better highlighted by the review of the following detailed description of a preferred, but not exclusive, embodiment illustrated by way of example and without limitations, with the aid of the accompanying drawings, in which.

DETAILED DESCRIPTION OF THE INVENTION

Figure 1:
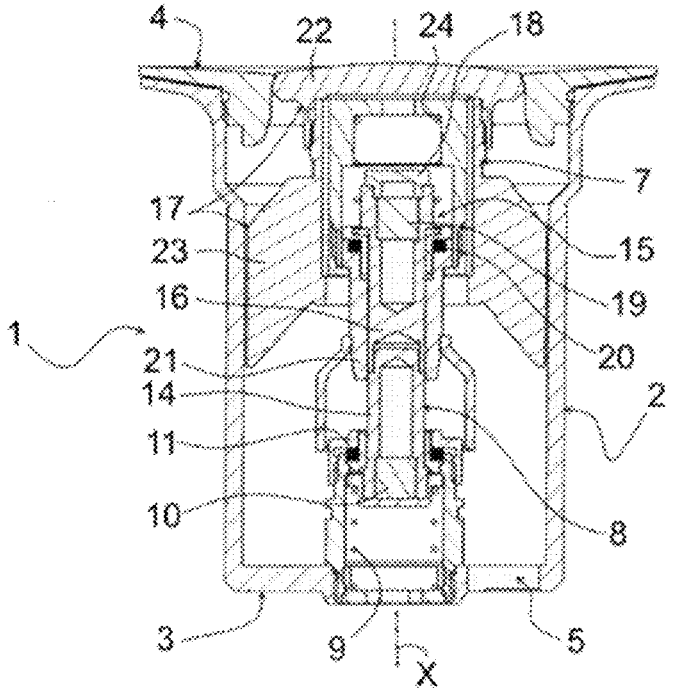
FIG. 1 is a sectional view of a drain according to the present invention, considered on a plane passing through the longitudinal axis X of the drain, in a first closing configuration.
Figure 2:
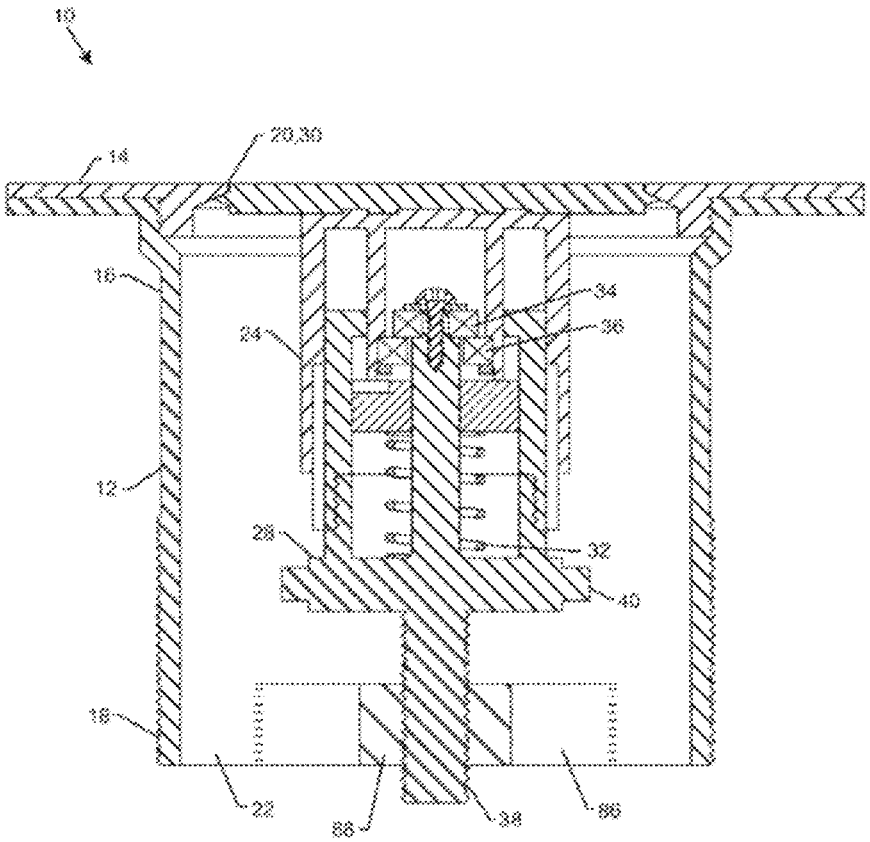
FIG. 2 is a sectional view of the drain shown in FIG. 1, considered on a plane passing through the longitudinal axis X of the drain, in a second opening configuration of the overflow.
Figure 3:
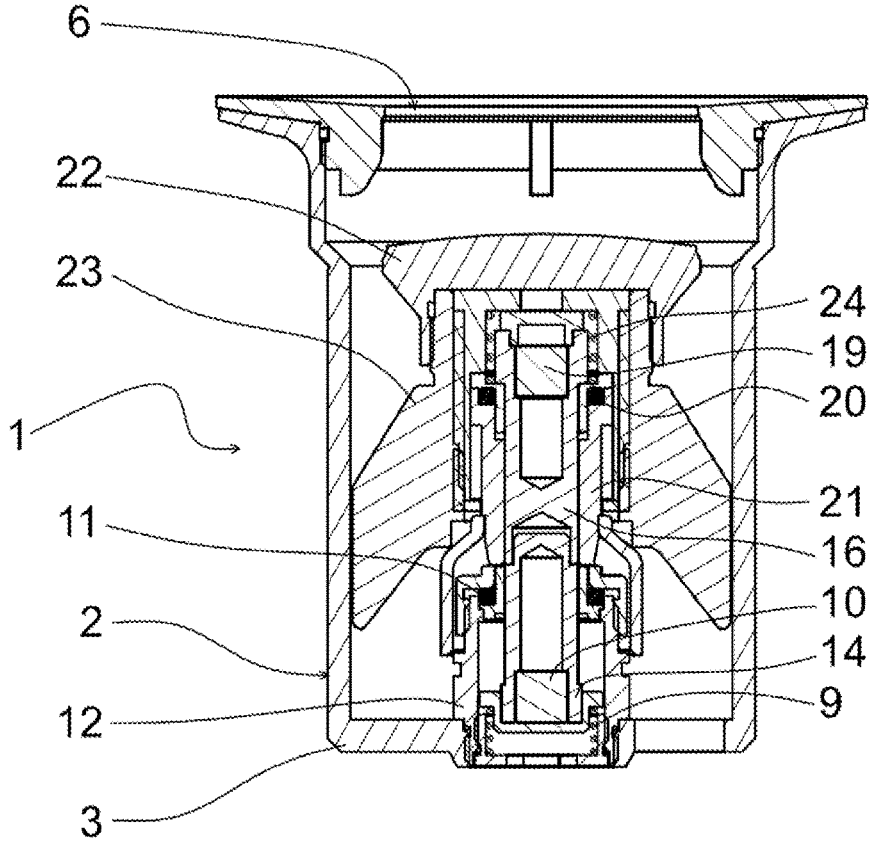
FIG. 3 is a sectional view of the drain shown in FIG. 1, considered on a plane passing through the longitudinal axis X of the drain, in a third reloading configuration.

With reference to FIGS. 1-3, a drain according to the present invention is denoted by the numerical reference 1 and comprises a body 2 in turn provided with a base 3 and a top 4, in practice a rosette. At least one opening 5 for draining the water is present in the base 3; the base 3 can also be configured as a grid. The top 4 delimits a mouth 6 through which the water drained from the sanitary fixture through the drain 1 flows.

A plug 7, susceptible of displacements (translations) on the longitudinal axis X between a raised position and a lowered position, is housed in the body 2 of the drain 1. In the raised position, the plug 7 seals the mouth 6, thus preventing the passage of water; in the lowered position, the plug 7 is not flush with the rosette 4 and does not close the mouth 6, thus allowing the draining of the water.

The plug 7 is supported by a lifting mechanism 8, whose function is to bring back the plug 7 to the raised position in response to a force imparted by the user, as will be explained below.

The drain 1 is provided with an overflow mechanism 15 combined with the plug 7 and distinct from the lifting mechanism 8. The operation of the overflow mechanism 15 is to allow the plug 7 to automatically lower, thus opening the mouth 6 when a threshold value of the water pressure acting on the plug 7 itself is exceeded, i.e. when a maximum level of water contained in the sanitary fixture is exceeded.

More in detail, the plug 7 comprises a head 17 cooperating with the inner edge of the mouth 6 for sealing the same mouth 6 and for preventing the passage of water. The outer diameter of the head 17, which is circular, corresponds to the inner diameter of the mouth 6. If necessary, an O-ring gasket is mounted on the head 17, otherwise it is dry-sealed, the sealing being achieved thanks to the shape-coupling of the head 17 with the inner edge of the mouth 6.

The plug 7 comprises a central stem 16 coaxial with the longitudinal axis X. The head 17 of the plug 7 is coaxially fitted on the upper portion 18 of the stem 16 and is slidable relative thereto between a raised position and a lowered position; in other words, the head 17 is constrained to the stem 16 with a telescopic coupling, so that to move with respect to the upper portion 18 of the stem 16 between a raised, or distal, position and a lowered, or proximal, position.

The overflow mechanism 15 comprises a first magnetic element 19 arranged on the upper portion 18 of the stem 16, and a second magnetic element 20 integral with the head 17 of the plug 7. The second magnetic element 20 is in a position in-between the base 3 and the first magnetic element 19.

The stem 16 is translatable along the longitudinal axis X, in particular moving with respect to the housing 12 provided at the base 3; thus, the first magnetic element 19 moves together with the stem 16 when it is pushed downwards by the user, thus causing the uncoupling of the magnetic elements 10 and 11 of the lifting mechanism 8 and the compression of a respective helical spring 9, as will be described in more detail below. When the stem 16 is stationary with respect to the body 2 of the drain 1, also the first magnetic element 19 is stationary.

In the raised position of the plug 7, corresponding to the raised position of the head 17 and to the mouth 6 being closed, the first magnetic element 19 and the second magnetic element 20 are magnetically coupled, i.e. they attract and are close to one another.

The operation of the overflow mechanism 15 is simple. When a threshold of the water pressure acting on the head 17 of the plug 7 is exceeded, the first magnetic element 19 and the second magnetic element 20 are automatically uncoupled, thus moving away from one another, causing the descent of the head 17 towards the lowered position and thus causing the opening of the mouth 6. Following the activation, the overflow mechanism 15 does not bring back the plug 7 to the raised position: the plug remains in the lowered position shown in FIG. 2, with the consequence that the whole volume of water contained in the sanitary fixture is drained. This circumstance is acceptable for example in sinks, because they usually contain few liters of water with respect to a bathtub, for example.

In practice, the manufacturer of the drain 1 will take care to select the magnetic elements 19 and 20 with the calibration corresponding to the maximum level of water desired. In other words, the magnetic elements 19 and 20 are selected to ensure the respective magnetic uncoupling when the maximum level of water is exceeded.

Preferably, the head 17 further comprises a bushing 21 slidingly fitted on the stem 16 of the plug 7, and an upper portion 22, which is the portion that physically carries out the closing of the mouth 6 in the raised position. The upper portion 22 is fitted on the bushing 21 with a telescopic coupling.

The function of the bushing is the following: the bushing 21 and the upper portion 22 of the plug 7 are integrally movable along the longitudinal axis X between the raised position and the lowered position of the head 17, i.e. are integral in the movement that brings the head 17 from the position shown in FIG. 1 to the position shown in FIG. 2. The bushing 21 returns inside the upper portion 22 of the head 17 of the plug 7, thus allowing the further lowering of the upper portion 22 in the body 2 of the drain 1, when the bushing 21 reaches a descent stop, corresponding to the overflow mechanism 15 being active and the mouth 6 being open. In practice, the descent stop of the bushing 21 is constituted by the housing 12: the bushing 21 goes in abutment against the edge of the first hole 13.

In the example shown in the figures, the second magnetic element 20 is arranged aboard the bushing 21 and is preferably toroidal.

By looking at the figures, it can be noted that the first magnetic element 19 always remains above the second magnetic element 20.

The overflow mechanism 15 comprises a first elastic element 24, in practice a first helical spring, interposed between the head 17 and the stem 16 of the plug 7. The helical spring 24 can be compressed for reloading the overflow mechanism 15, i.e. for bringing the first magnetic element 19 and the second magnetic element 20 back to magnetic coupling following the activation of the overflow mechanism 15.

In practice, when the overflow mechanism 15 is activated, the plug automatically lowers from the raised position shown in FIG. 1 to the lowered position shown in FIG. 2 because the magnetic elements 19 and 20, initially coupled to hold the plug 7, separate: the thrust exerted by the water being greater than the magnetic attraction between the magnetic elements 19 and 20. Following the relative activation, in order to reload the overflow mechanism 15, i.e. to bring it back to the raised position of FIG. 1, the user must exert a downwards thrust as shown in FIG. 3, thus compressing the helical spring 24 and bringing back the magnetic elements 19 and 20 to coupling (magnetic), i.e. close to or in contact with one another.

At this point, as explained above, by releasing the plug 7, a second elastic element 9, belonging to the lifting mechanism 8, brings back the plug 7 to the raised position with the overflow mechanism 15 ready for a new activation.

As will now be described, the overflow mechanism 15 cooperates with the lifting mechanism 8, for which the Applicant reserves the right to deposit a divisional patent application.

As disclosed above, the lifting mechanism 8 comprises a second elastic element 9, in practice a second helical spring interposed between the base 3 and the plug 7. The spring 9 operates by compression, i.e. it is compressed by the user and, by returning to is original length, pushes the plug 7 upwards to bring to in the raised position. The lifting mechanism 8 further comprises:

- a third magnetic element 10 fastened to the plug at its lower portion 14 and, more particularly, on a stem 16 of the plug 7 (to which its lower portion 14 belongs), and
- a fourth magnetic element 11 fastened to the body 2 of the drain 1.

A second elastic element 9 is also interposed between the plug 7 and the base 3 of the body 2 of the drain 1, preferably a helical spring as shown in the figures, that is compressed when the plug 7 is pushed downwards and that, when the thrust on the plug 7 ceases, exerts an upwards thrust on the plug 7 by extending to the initial length.

The thrust exerted by the helical spring 9 is preferably sufficient to bring back the plug 7 to the respective raised position; if not, the third magnetic element 10 and the fourth magnetic element 11 cooperate to ensure the proper operation of the plug, in the sense that the fourth magnetic element 11 attracts the third magnetic element 10 until bringing it to the height provided. In other words, when the helical spring 9 is not sufficient to raise the plug, the two magnetic elements 10 and 11 intervene and ensure the repositioning of the plug at the height corresponding to the raised position by magnetically coupling with one another.

The helical spring 9 of the lifting mechanism 8 is preferably arranged in a housing 12 extending towards the inside of the body 2 of the drain 1, starting from the base 3. The housing 12 is perforated on top: the stem 16 of the plug 7 is slidingly inserted through a first hole 13 obtained on the portion of the housing 12 opposite the base 2. As can be noted by looking at the figures, the third magnetic element 10 is positioned at the lower end of the stem 16 of the plug 7 and the fourth magnetic element 11 is toroidal and extends around the first hole 13; since the stem 16 cannot slip out of the housing 12, the third magnetic element 10 is always at a lower, or at most corresponding, height with respect to the fourth magnetic element 11.

The operation of the lifting mechanism 8 is simple. Following the lowering of the plug, caused by the voluntary action of the user or by the intervention of an overflow mechanism 15, the plug 7 switches from the raised position shown in FIG. 1 and corresponding to the mouth 6 being closed, to a lowered position shown in FIG. 2 and corresponding to the mouth 6 being open for the draining of the water. In order to bring back the plug 7 to the raised position shown in FIG. 1, the user must exert a downwards thrust on the plug 7 itself, i.e. must manually push the plug 7 towards the base 3 to magnetically uncouple the magnetic elements 10 and 11 and compress the helical spring 9, as shown in FIG. 3.

In particular, FIG. 3 shows the drain 1 in a third configuration for reloading both the lifting mechanism 8 and the overflow mechanism 15: the springs 9 and 24 being completely compressed, the stem 16 and the head 17 being at the respective lower stop.

Figure 4:
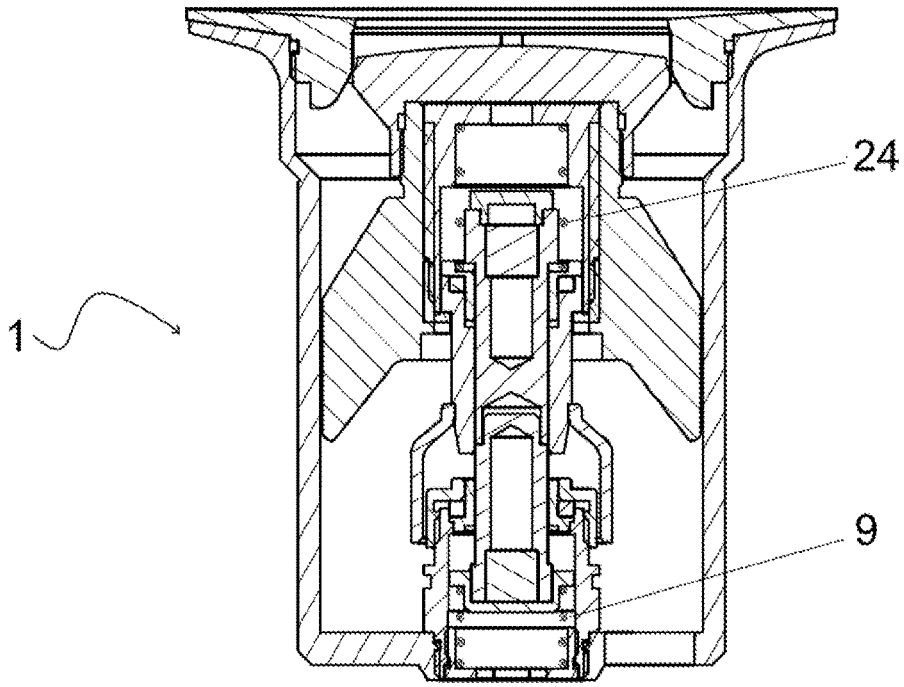
FIG. 4 is a sectional view of the drain shown in FIG. 1, considered on a plane passing through the longitudinal axis X of the drain, in a fourth reclosing configuration.

FIG. 4 shows the drain 1 in a fourth configuration for returning to the closed position: the plug 7 being raised to reach the configuration shown in FIG. 1. As shown in FIG. 4, the spring 24 extends first, i.e. the head 17 of the plug 7 is raised with respect to the stem 16 and, in a second moment, the spring 9 extends to raise the whole stem 16 and thus the whole plug 7 with the overflow mechanism 8 already armed.

At this point, by releasing the plug 7, the helical spring 9, extending itself, raises the plug 7 towards the raised position and, as explained above, the magnetic elements 10 and 11 magnetically couple to ensure the positioning and keeping of the raised position of the plug 7.

It is thus clear that the closing of the mouth 6 by the overflow mechanism 15 is subordinated both to the compression of the spring 24 and to the activation of the lifting mechanism 8 determined by the compression of the spring 9.

As can be noted by looking at the pictures, the overflow mechanism 15 and the lifting mechanism 8 are at different heights with respect to the axis of the drain. In particular, in the examples shown, the two mechanisms 8 and 15 are coaxial and the overflow mechanism 15 is above the lifting mechanism 8.

The integration between the lifting mechanism 8 and the overflow mechanism 15 can easily be achieved by taking care to calibrate the magnetic elements 10, 11, 19, 20 so that the force necessary for separating the first magnetic element 19 from the second magnetic element 20 is lower than the force necessary for separating the third magnetic element 10 from the fourth magnetic element 11.

More in particular, the force necessary for separating the first magnetic element 19 from the second magnetic element 20 is exerted by the water being at the maximum level allowed in the sanitary fixture; the force necessary for separating the third magnetic element 10 from the fourth magnetic element 11 is exerted manually by the user with a finger, by pushing the plug 7 towards the base 3 of the body 2 of the drain 1.

The solution suggested is particularly appropriate for use in sinks, wherein very hot or dirt water or water mixed with aggressive detergents is often used, and immersing the hands may not be possible without gloves. Moreover, in sinks, it is preferable to have an overflow mechanism 15 devoid of automatic raising, because the maximum volume of water contained in sinks is limited and can be drained in a few seconds.

The invention claimed is:

1. A drain for sanitary fixtures, comprising:

a body fastenable to a sanitary fixture provided with a base and a top, wherein the base comprises an opening for draining the water and the top delimits a mouth for the inlet of water in the body of the drain;

a plug housed in the body of the drain and movable with respect to the body between a lowered position, where the plug does not intercept the mouth, thus allowing the passage of water, and a raised position, where the plug closes the mouth and prevents the passage of water, an overflow mechanism combined with the plug and configured to allow the plug to automatically lower by opening the mouth when a threshold value of the water pressure acting on the plug is exceeded, wherein the overflow mechanism is magnetic and comprises a first elastic element, wherein, following an activation of the overflow mechanism, the reloading of the overflow mechanisms is conditional to a compression of the first elastic element exerted by a user.

2. The drain according to claim 1, wherein the plug comprises a stem extending along a longitudinal axis between a lower portion and an upper portion, and a head cooperating with the inner edge of the mouth for sealing the mouth and for preventing the passage of water, wherein the head is coaxially fitted on the upper portion of the stem and is slidable relative thereto between a raised position and a lowered position with respect to the upper portion of the stem, wherein the overflow mechanism comprises a first magnetic element arranged on the upper portion of the stem, and a second magnetic element integral with the head and in-between the base and the first magnetic element, and wherein, in the raised position of the plug, corresponding to the raised position of the head the first magnetic element and the second magnetic element are magnetically coupled and wherein, when a threshold value of the water pressure acting on the head is exceeded, the first magnetic element and the second magnetic element are automatically uncoupled, causing the descent of the head towards the lowered position, corresponding to the opening of the mouth.

3. The drain according to claim 2, wherein the head comprises a bushing slidingly fitted on the stem and an upper portion, of the head, fitted on the bushing with a telescopic coupling, wherein said upper portion of the head carries out the closing of the mouth in the raised position, wherein the bushing and the upper portion of the head of the plug are integrally movable along the longitudinal axis between the raised position and the lowered position of the head, and the bushing returns inside the upper portion of the head thus allowing the further lowering of the upper portion of the head in the body of the drain, when the bushing reaches a descent stop, corresponding to the overflow mechanism being active and the mouth being open.

4. The drain according to claim 3, wherein a housing provided on the base acts as a descent stop for the bushing and wherein the second magnetic element is arranged aboard the bushing.

5. The drains according to claim 2, wherein the first elastic element is interposed between the head and the stem of the plug, and wherein the first elastic element can be compressed for bringing the first magnetic element and the second magnetic element back to magnetic coupling, following the activation of the overflow mechanism.

6. The drain according to claim 1, comprising a lifting mechanism to raise the plug following the activation of the overflow mechanism, the lifting mechanism being intended to bring the plugs back to the raised position, in response to a stress exerted by the user.

7. The drain according to claim 6, wherein the lifting mechanism comprises a second elastic element being deformable during the descent of the plug, the plug comprises a third magnetic element and the lifting mechanism comprises a fourth magnetic element, the third magnetic element is in-between the base of the body and the fourth magnetic element, and the second elastic element exerts a thrust on the plug towards the relative raised position, and wherein, in the raised position of the plug, the third magnetic element and the fourth magnetic element are magnetically coupled.

8. The drain according to claim 7, wherein the fourth magnetic element is stationary with respect to the body.

9. The drain according to claim 8, comprising a housing extending from the base towards the inside of the body, and wherein a first hole is obtained at the end of the housing opposite the base, and a lower portion of the plug is slidingly inserted in said first hole and the third magnetic element is arranged on said lower portion and moves with it inside the housing between a lowered position and a raised position, and wherein the fourth magnetic element is positioned at the first hole, integral with the housing and, therefore, with the body.

10. The drain according to claim 9, wherein the second elastic element, preferably a helical spring, is positioned inside the housing functionally interposed between the base of the body and the lower portion of the plug.

11. The drain according to claim 9, wherein the second elastic element, preferably a helical spring, is positioned inside the housing functionally interposed between the base of the body and the lower portion of the plug.

12. The drain according to claim 9, wherein the third magnetic elements is arranged on the lower portion of the plug, under the fourth magnetic element, and the magnetic coupling between the third magnetic element and the fourth magnetic element occurs at the stop of the lower portion of the plug, the lower portion being completely raised in the housing.

13. The drain according to claim 7, wherein the magnetic coupling between the third magnetic element and the fourth magnetic element is revertible, the third magnetic element being manually separated/moved away from the fourth magnetic element by exerting a thrust on the plug.

14. The drain according to claim 13, wherein the switching of the plug from the lowered position to the raised position occurs in response to the initial compression of the second elastic element and the first elastic element, exerted by the user, and to the successive extension of the second elastic element and the first elastic element.

15. The drain according to claim 13, wherein the third magnetic element, the fourth magnetic element, the first magnetic element and the second magnetic element are calibrated so that the force necessary for separating the first magnetic element from the second magnetic element is lower than the force necessary for separating the third magnetic element from the fourth magnetic element.

16. The drain according to claim 15, wherein the force necessary for separating the first magnetic element from the second magnetic element is exerted by the water being at the maximum level allowed in the sanitary fixture, and the force necessary for separating the third magnetic element from the fourth magnetic element is exerted manually by the user by pushing the plug towards the base of the body of the drain.

17. The drain according to claim 6, wherein the overflow mechanism is independent from the lifting mechanism while opening the mouth when the threshold value of the water pressure acting on the plug is exceeded.

18. The drain according to claim 6, wherein the closing of the mouth by the overflow mechanism is conditional to the activation of the lifting mechanism by the user.

19. The drain according to claim 6, wherein the overflow mechanisms and the lifting mechanism are housed in the drain at different heights.

20. The drain according to claim 6, wherein the raising of the plug following the activation of the overflow mechanism is conditional to both the compression of the first elastic element of the overflow mechanism and to the activation of the lifting mechanism determined by the compression of a second elastic element of the lifting mechanism.

* * * * *